US012472544B2

(12) United States Patent
Junge et al.

(10) Patent No.: US 12,472,544 B2
(45) Date of Patent: Nov. 18, 2025

(54) METHOD FOR PRODUCING A SURFACE-TREATED AND SURFACE-CONDITIONED STEEL SHEET

(71) Applicant: ThyssenKrupp Steel Europe AG, Duisburg (DE)

(72) Inventors: Fabian Junge, Düsseldorf (DE); Burak William Cetinkaya, Dortmund (DE); Jennifer Schulz, Unna (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 638 days.

(21) Appl. No.: 17/790,864

(22) PCT Filed: Jan. 5, 2021

(86) PCT No.: PCT/EP2021/050070
§ 371 (c)(1),
(2) Date: Jul. 5, 2022

(87) PCT Pub. No.: WO2021/144164
PCT Pub. Date: Jul. 22, 2021

(65) Prior Publication Data

US 2023/0019066 A1 Jan. 19, 2023

(30) Foreign Application Priority Data

Jan. 13, 2020 (DE) ..... 102020200326.2

(51) Int. Cl.
*B21B 1/22* (2006.01)
*C23C 2/26* (2006.01)
*C23C 22/07* (2006.01)

(52) U.S. Cl.
CPC ..... *B21B 1/227* (2013.01); *C23C 2/26* (2013.01); *C23C 22/07* (2013.01); *B21B 2001/228* (2013.01)

(58) Field of Classification Search
None
See application file for complete search history.

(56) References Cited

U.S. PATENT DOCUMENTS 4,369,211 A 1/1983 Nitto et al.
2003/0113575 A1 6/2003 McDevitt
(Continued)

FOREIGN PATENT DOCUMENTS

CN 1264750 A 8/2000
CN 101443132 A 5/2009
(Continued)

OTHER PUBLICATIONS

English language machine translation of WO-2009049836-A1. Generated Apr. 18, 2025. (Year: 2025).*
(Continued)

*Primary Examiner* — Brian D Walck
(74) *Attorney, Agent, or Firm* — RMCK Law Group PLC

(57) ABSTRACT

The present disclosure relates to a process for producing a surface-treated and surface-finished sheet steel. A sheet steel having a zinc-based coating is provided, wherein zinc grains are distributed within the coating. The surface-treated sheet steel are skin-pass rolled to form embossed regions and unembossed regions on the surface of the sheet steel provided with a zinc-based coating. Skin-pass rolling is performed with a degree of skin-pass greater than 1% in such a way that due to the force exerted by the skin-pass rolling the zinc grains in the embossed region are altered in dimension relative to the zinc grains in the unembossed region.

6 Claims, 2 Drawing Sheets

(56) References Cited

U.S. PATENT DOCUMENTS

Figure 1:
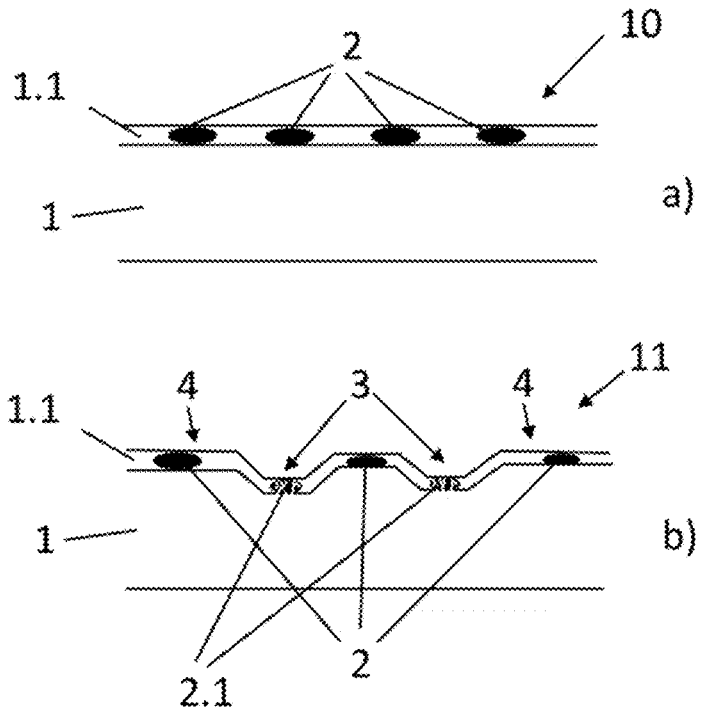

| | | | |
|---|---|---|---|
| 2009/0297881 | A1 | 12/2009 | Maalman et al. |
| 2010/0035080 | A1 | 2/2010 | Sigler et al. |
| 2013/0086960 | A1 | 4/2013 | Hoshino et al. |
| 2019/0176198 | A1 | 6/2019 | Beier et al. |
| 2020/0332379 | A1 | 10/2020 | Friedel et al. |

FOREIGN PATENT DOCUMENTS

| | | | | |
|---|---|---|---|---|
| CN | 101454474 | A | | 6/2009 |
| CN | 101617059 | A | | 12/2009 |
| CN | 101619643 | A | | 1/2010 |
| CN | 101905240 | A | | 12/2010 |
| CN | 101960050 | A | | 1/2011 |
| CN | 102395695 | A | | 3/2012 |
| CN | 102575330 | A | | 7/2012 |
| CN | 102884219 | A | | 1/2013 |
| CN | 103361588 | A | | 10/2013 |
| CN | 109715838 | A | | 5/2019 |
| DE | 102009007909 | A1 | | 8/2010 |
| DE | 102013100730 | | | 6/2014 |
| DE | 202015105104 | U | | 10/2015 |
| EP | 2006037 | B1 | | 8/2010 |
| EP | 2554707 | A1 | | 2/2013 |
| EP | 2892663 | B1 | | 11/2016 |
| JP | H07173595 | A | | 7/1995 |
| JP | H07180018 | A | | 7/1995 |
| JP | 2002060917 | A | | 2/2002 |
| JP | 2004156111 | A | * | 6/2004 |
| JP | 2004197120 | A | | 7/2004 |
| JP | 2005048198 | A | | 2/2005 |
| JP | 2006265614 | A | | 10/2006 |
| JP | 2008214681 | A | | 9/2008 |
| WO | WO-2009049836 | A1 | * | 4/2009 ..... C23C 2/06 |
| WO | 2017140605 | A1 | | 8/2017 |
| WO | 2018073116 | A2 | | 4/2018 |

OTHER PUBLICATIONS

English language machine translation of JP-2004156111-A. Generated Apr. 18, 2025. (Year: 2025).*

Asgari, H. et al., "Influence of force variations in skin pass rolling on texture and surface reactivity of hot dip galvanized low carbon steel sheets", Ironmaking & Steelmaking: Processes, Products and Applications, United Kingdom, vol. 35, No. 7, Oct. 18, 2008, pp. 545-548.

International Search Report and Written Opinion for International Application No. PCT/EP2021/050070 mailed Mar. 11, 2021.

Vincent, G., Textures, microstructures et proprietes mecaniques d'alliages de zinc en feuillards et en revetement: Autre. Universite Paul Verlaine—Metz 2004. Francais. NNT: 2004METZ013S.

Chinese Office Action for CN Application No. 202180008977.6 mailed Aug. 1, 2023.

Chinese Search Report for CN Application No. 2021800089776 mailed Jul. 28, 2023.

Notification regarding granting the Patent Right for CN Application No. 202180008977.6 mailed Jan. 29, 2024.

* cited by examiner

METHOD FOR PRODUCING A SURFACE-TREATED AND SURFACE-CONDITIONED STEEL SHEET

CROSS-REFERENCE TO RELATED APPLICATIONS

This application is a 371 U.S. National Stage of International Application No. PCT/EP2021/050070, filed Jan. 5, 2021, which claims the benefit of German Patent Application No. 10 2020 200 326.2 filed Jan. 13, 2020. The disclosures of each of the above applications are incorporated herein by reference in their entirety.

The present invention relates to a process for producing a surface-treated and surface-finished sheet steel, wherein the process comprises the steps of:

- providing a sheet steel having a zinc-based coating, wherein zinc grains are distributed within the coating,
- skin-pass rolling the surface-treated sheet steel to form embossed regions and unembossed regions on the surface of the sheet steel provided with a zinc-based coating.

A standard surface finishing process for (cold) rolled sheet (steel) is skin-pass rolling. During the skin-pass rolling operation a roller having shaping elements is pressed on to one side of a sheet or a sheet is passed between a roller pair having shaping elements for skin-pass rolling on both sides. In the ideal case the contact of the sheet with the skin-pass roller causes the negative of the roller topography to be depicted on the sheet. This allows desired roughness characteristics to be achieved on the sheet surface and also allows targeted adjustment of mechanical characteristics of the material. While roughness generally has a decisive influence on wettability, adhesive suitability and the reactivity of the surface, adjustment of the mechanical characteristics is directed at achieving desired forming properties of the sheet.

There are different texturing processes by which the shaping elements on the roller are generated. In electrical discharge texturing (EDT) the roller surface is roughened by spark erosion and a stochastic topography is created insofar as the size and depth of the resulting craters vary depending on the energy transfer of the spark impact and the roller texture therefore does not follow a periodic pattern, see for example EP 2 006 037 B1. In laser texturing (LT) the roller surface is processed by laser beam bombardment and it is possible to produce targeted structures with a deterministic topography, see for example EP 2 892 663 B1.

The forming properties of a sheet or the surface of a sheet may vary according to the coating. For example, zinc-based coatings produced by hot-dip coating comprising proportions of Mg exhibit improved formability compared to zinc-based coatings without Mg. The eutectic mixture or the intermetallic phase present in the eutectic mixture formed in the zinc-based coating comprising Mg in the hot-dip coating process is (markedly) harder than the surrounding matrix (coating) and fractures under the mechanical force exerted in the context of the skin-pass rolling and/or forming process. The resulting "microfractures" in the intermetallic phase can ensure lower coefficients of friction and thus lower-wear forming. Improved wear behavior can reduce or obviate the need, for example, for addition oiling which would otherwise be advantageous/necessary for wear-free forming. Furthermore, the occurrence of such cracks may be advantageous for phosphatability, paint bonding and later paint finish.

It is an object of the invention to specify a process for producing a surface-treated and surface-finished sheet steel which makes it possible to improve the phosphatability, formability and/or paint finish of surface-treated and surface-finished sheet steels.

The object is achieved with the features of claim 1.

The inventors have surprisingly found that it is possible to have a positive effect on phosphatability, formability and/or paint finish when skin-pass rolling is performed with a degree of skin-pass greater than 1% in such a way that due to the force exerted by the skin-pass rolling the zinc grains in the embossed region are altered in dimension relative to the zinc grains in the unembossed region. Adapting the degree of skin-pass to greater than 1%, in particular greater than 1.2%, preferably greater than 1.4%, makes it possible to alter the zinc grains in the embossed region, wherein the especially "targeted" effect, for example destroying or damaging the zinc grains in the embossed region, makes it possible to generate advantageous further "microfractures" on the surface of the coating additional to those already formed in the intermetallic phase which can preferably enhance chemical reactivity by increasing the surface area within the embossed regions. This makes it possible not only to achieve better phosphatability and/or bonding of polymeric systems but also to ensure improved wettability and/or formability.

In the embossed regions "microfractures" can be achieved in the intermetallic phases even at a degree of skin-pass of less than 1%. However, the force exerted or mechanical stress appears to be too low and the zinc grains in the embossed regions are thus not damaged and/or fractured.

Sheet steel is to be understood as meaning a flat steel product in strip form or sheet/plate form. It has a longitudinal extent (length), a transverse extent (width) and a vertical extent (thickness). The sheet steel may be hot strip (hot-rolled steel strip) or cold strip (cold-rolled steel strip) or may be produced from hot strip or from cold strip. The surface of the sheet steel is preferably skin-pass rolled using one or more skin-pass rollers, wherein embossed regions are introduced in a rolling stand in a rolling train, in a coating train or separately in a (post-)rolling stand.

"Dimension" is to be understood as meaning a size, in particular at least one extent in length, width and/or height, and/or an orientation, in particular the crystal orientation (grain orientation), of the zinc grain(s). The "dimension" may be determined by generating a two- or three-dimensional representation of the surface-treated and surface-finished sheet steel from which, using standard processes, size and orientation may be determined, for example using optical microscopy and/or SEM micrographs on transverse sections (in the region of the coating) and/or SEM micrographs of the surface of the coating.

The dimensions of the embossed regions (depth, width, etc.) depend inter alia on the degree of skin-pass which may be for example up to 5%, in particular up to 4%, preferably up to 3%, preferably up to 2.5%, particularly preferably up to 2%, wherein the degree of skin-pass expresses the ratio of the thickness reduction (entry thickness to exit thickness in the rolling stand) of the rolled sheet steel to the entry thickness, in particular takes into account the thickness reduction. As a result of the skin-pass rolling the surface-treated and surface-finished sheet steel has a surface structure.

The thickness of the sheet steel is for example 0.5 to 4.0 mm, in particular 0.6 to 3.0 mm, preferably 0.7 to 2.5 mm.

Further advantageous embodiments and developments are apparent from the description below. One or more features from the claims, the description and the drawing may be linked with one or more other features therefrom to form further embodiments of the invention. It is also possible for one or more features from the independent claims to be linked by one or more other features.

In one embodiment of the process according to the invention the zinc grains in the embossed region are smaller in size than the zinc grains in the unembossed region of the surface-treated and surface-finished sheet steel. As a result of the force exerted by the skin-pass rolling the zinc grains are affected, in particular damaged and/or fractured, in such a way that the original zinc grains may be converted into smaller zinc grains, with the result that recrystallization of the smaller zinc grains can occur. The zinc grains altered in the embossed region thus preferably differ not only in their size but also in their orientation relative to the original zinc grains or the zinc grains in the unembossed region. Thus, above a degree of skin-pass of 1% or by adapting the degree of skin-pass to more than 1% it is possible to effect targeted generation of further advantageous "microfractures" additional to those already present in the intermetallic phase.

In one embodiment of the process according to the invention the zinc-based coating has the following composition in % by weight:

optionally one or more alloying elements from the group (Al, Mg):

Al up to 5.0,

Mg up to 5.0, balance Zn and unavoidable impurities.

The zinc-based coating may contain not only zinc and unavoidable impurities but also additional elements such as aluminum in a content of up to 5.0% by weight and/or magnesium in a content of up to 5.0% by weight. Sheet steels having a zinc-based coating have very good cathodic corrosion protection and have been used in automotive construction for years. If improved corrosion protection is intended the coating additionally comprises magnesium in a content of at least 0.05% by weight, in particular of at least 0.3% by weight, preferably of at least 0.5% by weight. Aluminum may be present alternatively or in addition to magnesium in a content of at least 0.05% by weight, in particular of at least 0.3% by weight, preferably of at least 0.5% by weight. It is particularly preferable when the zinc-based coating comprises aluminum and magnesium in each case in a content of at least 0.5% by weight to be able to provide improved cathodic protection.

In one embodiment of the process according to the invention the zinc-based coating has a thickness between 2 and 20 μm, in particular between 4 and 15 μm, preferably between 5 and 12 μm.

In a preferred embodiment of the process according to the invention the skin-pass rolling introduces a deterministic surface structure into the surface-treated sheet steel. The term "deterministic surface structure" is in particular to be understood as meaning regularly recurring surface structures having a defined shape and/or design or dimensions. This especially includes surface structures having a (quasi)-stochastic appearance which are composed of stochastic shape elements having a recurring structure. The introduction of a stochastic surface structure is alternatively also conceivable.

In one embodiment of the process according to the invention the surface-treated and surface-finished sheet steel is phosphated. Altering the surface in the embossed regions also makes it possible to achieve improved phosphatability. Increasing the surface area via the further generated "microfractures" in the embossed regions has the result that for example in a zinc phosphating the zinc ions are better able to pass into the phosphating bath and form a conversion chemistry, thus allowing substantially homogeneous formation of the phosphate layer, in particular with small/fine crystals, which can meet the stringent requirements of the automakers.

Specific embodiments of the invention will be described in more detail below with reference to the drawing. The drawing and accompanying description of the resulting features should not be read as limiting to the respective embodiments, but serve to illustrate exemplary embodiments. Furthermore, the respective features may be used with one another and with features of the above description for possible further developments and improvements of the invention, specifically in additional embodiments which are not illustrated.

Figure 2:
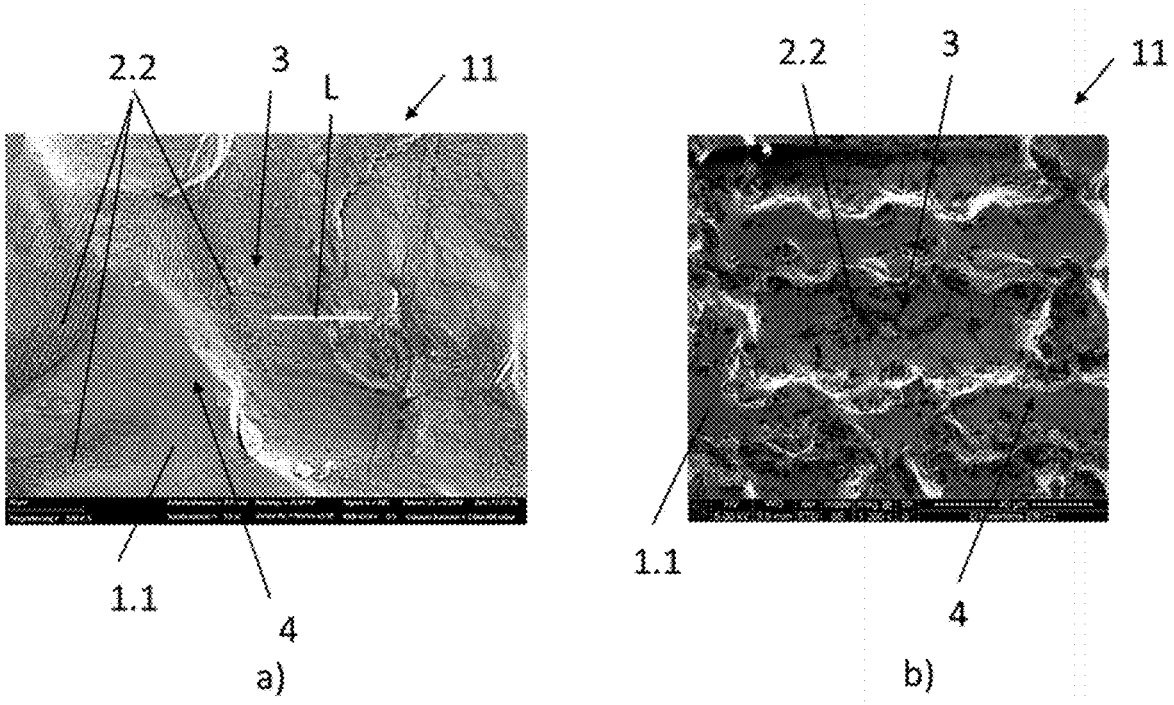
Figure 3:
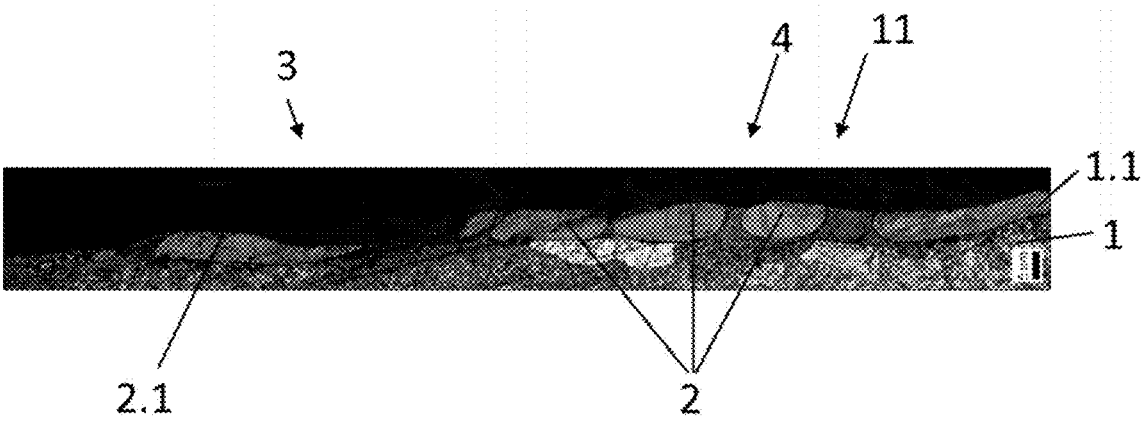

In the drawings:

FIGS. 1 *a, b*) shows schematic partial sections of a provided, surface-treated sheet steel a) and a surface-treated and surface-finished sheet steel b), FIGS. 2*a, b*) each show a micrograph of a subregion of a surface of a surface-treated and surface-finished sheet steel having a stochastic surface structure a) and having a deterministic surface structure b), FIG. 3) shows a micrograph of a subregion of a surface-treated and surface-finished sheet steel in a transverse section along the line in FIG. 2*a*) and FIG. 4*a, b*) each show a micrograph of a subregion of a surface of a surface-treated, surface-finished and phosphated sheet steel which was not subjected to skin-pass rolling according to the invention a) and according to the invention b).

FIG. 1 shows schematic partial sections before and after skin-pass rolling. FIG. 1 *a*) is a schematic diagram of a partial section of the upper portion of a provided, surface-treated sheet steel (10). The surface-treated sheet steel (10) comprises a sheet steel (1) having a zinc-based coating (1.1), wherein zinc grains (2) are arranged distributed within the coating (1.1). In addition to zinc and unavoidable impurities the zinc-based coating (1.1) may optionally also contain one or more alloying elements from the group (Al, Mg): Al up to 5.0, Mg up to 5.0. The thickness of the sheet steel (1) is 0.5 to 4.0 mm for example. The provided, surface-treated sheet steel (10) is supplied to a skin-pass rolling which is performed such that skin-pass rollers (not shown) comprising shaping elements act on both sides of the surface of the surface-finished sheet steel (10), wherein the skin-pass rolling forms embossed regions (3) and unembossed regions (4) on the surface of the sheet steel (1) provided with a zinc-based coating (1.1), cf. FIG. 1*b*). The skin-pass rolling may be used to introduce a deterministic or stochastic surface structure into the surface-treated sheet steel (10). The skin-pass rolling is performed with a degree of skin-pass greater than 1% in such a way that due to the force exerted by the skin-pass rolling the zinc grains (2.1) in the embossed region (3) are altered in dimension relative to the zinc grains (2) in the unembossed region (4) as illustrated in the schematic diagram in FIG. 1*b*). The zinc grains (2.1) in the embossed region (3) are smaller in size than the zinc grains (2) in the unembossed region (4) of the surface-treated and surface-finished sheet steel (11).

FIG. 2 in each case shows respective micrographs, recorded using a scanning electron microscope (SEM), of a subregion of a surface-treated and surface-finished sheet steel (11), wherein a stochastic surface structure, cf. FIG. 2*a*) and a deterministic surface structure, cf. FIG. 2*b*) have been produced. A sheet steel (1) made of a soft steel grade "CR4" was cold-rolled to a thickness of 0.7 mm and coated with a zinc-based coating (1.1) in a hot-dip coating system, wherein the coating (1.1) shown in FIG. 2*a*) contained 1.6% by weight of Al and 1.1% by weight of Mg and the coating (1.1) shown in FIG. 2*b*) contained 0.4% by weight of Al. The surface-treated sheet steel (10) was subject to skin-pass rolling with an EDT-textured skin-pass roller, not shown, (FIG. 2*a*)) and with an LT-textured skin-pass roller, not shown, (FIG. 2*b*)) in each case with a degree of skin-pass of 1.5%.

Irrespective of the type of surface structure it is apparent that from a degree of skin-pass above 1%, in particular above 1.2%, preferably above 1.4%, a change in the zinc grains (2.1) in the embossed region (3) may be effected, wherein the especially "targeted" force exertion, for example damaging or fracturing the zinc grains (2.1) in the embossed region (2) in FIG. 2*b*), allows advantageous microfractures (2.2) or in FIG. 2*a*) advantageous further microfractures (2.2) additional to those already formed in the intermetallic phase to be generated on the surface of the coating (1.1).

FIG. 3) shows a micrograph of a subregion of the surface-treated and surface-finished sheet steel (11) in a transverse section along the line (L) in FIG. 2*a*) which was recorded using a scanning electron microscope (SEM). The force exerted or mechanical stress in the embossed regions (4) results in damage to and/or fracturing of the zinc grains (2.1), thus altering the dimension relative to the original zinc grains or relative to the zinc grains (2) in the unembossed region (4).

Figure 4:
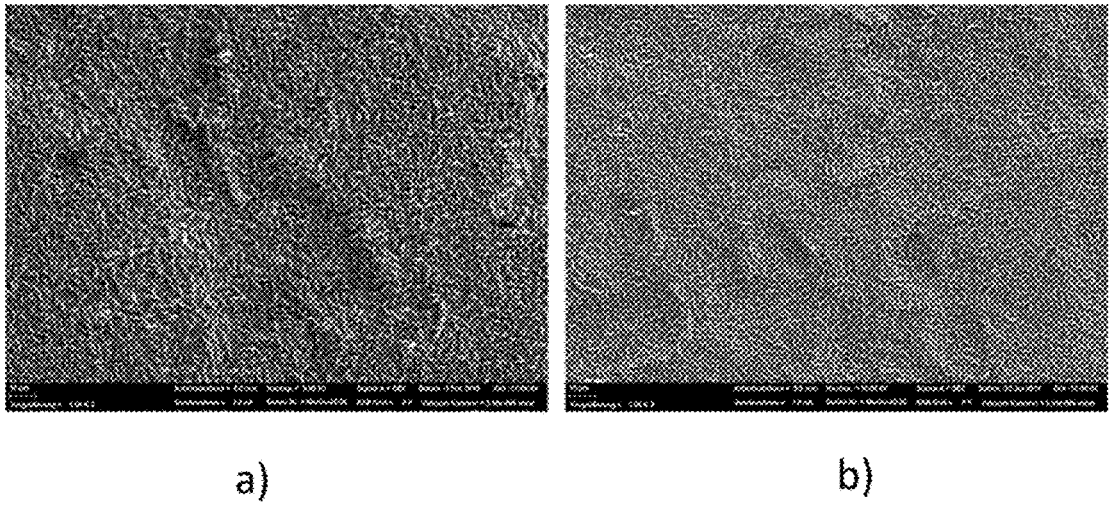

In a further investigation sheet steels (1) made of a soft steel grade "CR4" were each cold-rolled to a thickness of 0.7 mm and coated with a zinc-based coating (1.1) in a hot-dip coating system, wherein the coating (1.1) contained 1.4% by weight of Al and 1.2% by weight of Mg. The surface-treated sheet steels (10) were subjected to skin-pass rolling with an EDT-textured skin-pass roller (not shown) with different degrees of skin-pass. The different surface-treated and surface-finished sheet steels (11) were then phosphated. FIG. 4) shows respective micrographs of subregions of a surface of a surface-treated, surface-finished and phosphated sheet steel subjected to skin-pass rolling with a degree of skin-pass of 0.95%, cf. FIG. 4*a*), and according to the invention with a degree of skin-pass of 1.25%, cf. FIG. 4*b*). Compared to the noninventive skin-pass rolling the inventive configuration in the right-hand image shows a more homogenous phosphating with a more uniform zinc phosphate crystal growth compared to the left-hand image, with finer/smaller zinc phosphate crystals which are especially attributable to the further advantageous "microstructures" (2.2) due to the reduction in size of the original zinc grains and the recrystallized, smaller zinc grains (2.1).

The features described are all combinable with one another insofar as this is technically possible.

The invention claimed is:

1. A process for producing a surface-treated and surface-finished sheet steel, wherein the process comprises the steps of:

providing a sheet steel having a zinc-based coating, wherein zinc grains are distributed within the coating, skin-pass rolling the surface-treated sheet steel with a roller having shaping elements to form embossed regions and unembossed regions on the surface of the sheet steel provided with a zinc-based coating, wherein the skin-pass rolling is performed with a degree of skin-pass greater than 1% in such a way that due to the force exerted by the skin-pass rolling the zinc grains in the embossed region are altered in dimension to be smaller in size relative to the zinc grains in the unembossed region, wherein the zinc-based coating has the following chemical composition in % by weight:

Al 0.5 to 5.0; and

Mg 0.5 to 5.0;

residual Zn and unavoidable impurities.

2. The process as claimed in claim 1, wherein the zinc-based coating has a thickness between 2 and 20 μm.

3. The process as claimed in claim 2, wherein the skin-pass rolling introduces a deterministic surface structure into the surface-treated sheet steel.

4. The process as claimed in claim 2, wherein the skin-pass rolling introduces a stochastic surface structure into the surface-treated sheet steel.

5. The process as claimed in claim 4, wherein the surface-treated and surface-finished sheet steel is phosphate.

6. The process of claim 1 wherein the zinc-based coating has the following chemical composition in % by weight:

Al 0.5 to 5.0; and

Mg above 2.0 to 5.0;

residual Zn and unavoidable impurities.

* * * * *